US006293818B1

(12) United States Patent
Kim et al.

(10) Patent No.: US 6,293,818 B1
(45) Date of Patent: Sep. 25, 2001

(54) ELECTRICAL CONNECTOR FOR CONNECTING A FLEXIBLE PRINTED CIRCUIT TO A RIGID PRINTED CIRCUIT BOARD

(75) Inventors: Yong Soo Kim, Shiheung; Hee Seck Shin, Anson, both of (KR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/449,371

(22) Filed: Nov. 24, 1999

(30) Foreign Application Priority Data

Nov. 30, 1998 (KR) ..... 51996

(51) Int. Cl.[7] ..... H01R 12/24
(52) U.S. Cl. ..... 439/495
(58) Field of Search ..... 439/260, 60, 62, 439/64, 65, 630, 495, 67, 79, 492–494

(56) References Cited

U.S. PATENT DOCUMENTS 5,052,936 * 10/1991 Biechler et al. ..... 439/260
5,895,278 * 4/1999 Humphrey ..... 439/260
6,099,346 * 8/2000 Hashiguchi et al. ..... 439/260

* cited by examiner

*Primary Examiner*—Paula Bradley
*Assistant Examiner*—Shanetta D. Ore
(74) *Attorney, Agent, or Firm*—Stacey E. Caldwell

(57) ABSTRACT

An electrical connector for joining a flexible printed circuit to a rigid printed circuit board comprises a connector housing adapted to be mounted within an opening in the printed circuit board and including a circuit connecting portion for receiving the flexible printed circuit, a plurality of connection terminals mounted within the housing and terminating in surface mount portions wherein upper surfaces of the surface mount portions are adapted to make contact with corresponding circuit traces on a lower surface of the printed circuit board, a ground terminal extending outwardly from each side of the connector housing wherein the upper surface of the ground terminals are coplanar with the upper surfaces of the surface mount portions of the connection terminals, and a circuit fastener rotatably mounted for up and down movement on the connector housing adapted to secure the flexible printed circuit within the circuit connecting portion of the housing, whereby when the electrical connector is placed in the opening of the circuit board the overall profile of the connected portion is reduced by the thickness of the circuit board.

12 Claims, 6 Drawing Sheets

ELECTRICAL CONNECTOR FOR CONNECTING A FLEXIBLE PRINTED CIRCUIT TO A RIGID PRINTED CIRCUIT BOARD

FIELD OF THE INVENTION

The present invention relates to an electrical connector for connecting a flexible printed circuit to a rigid circuit board and, more particularly, to an electrical connector for joining a flexible printed circuit to a rigid circuit board when the connector is mounted within an opening of the circuit board.

DISCUSSION OF RELATED ART

In general, a connector is a connecting device for electrically joining wires, circuit boards and other circuit devices. The electrical connector in this specification is a device which is electrically joined to a printed circuit board of a small electronic apparatus, such as an LCD module of notebook computer or camcorder, and which receives a flexible printed circuit FIG. 1 is an exploded perspective view showing a combination of a conventional electrical connector and printed circuit board, and FIG. 2 is a cross-sectional view of the combination structure of FIG. 1. Referring to FIGS. 1 and 2, conventional electrical connector 10 includes a connector housing 12, a circuit connecting portion 14 formed in connector housing 12, a plurality of connection terminals 16 arranged in circuit connecting portion 14, a ground terminal 18 formed on each side of connector housing 12, and a circuit fastener 20 rotatably mounted on connector housing 12.

Connection terminals 16 electrically connect to connection terminals 32 of circuit board 30 and extend from an inside of circuit connecting portion 14 to the outside, terminating in surface mount portions. The lower surface of the surface mount portions of connection terminals 16 is coplanar with the lower surface of connector housing 12. Ground terminal 18 grounds and fixes electrical connector 10 to circuit board 30. Ground terminal 18 is joined to a ground circuit 34 of circuit board 30 by soldering. The lower surface of ground terminal 18 is also coplanar with the lower surface of connector housing 12.

Circuit fastener 20 is rotatably mounted for up and down movement on connector housing 12 to retain flexible printed circuit 40 within electrical connector 10. Electrical connector 10 is adapted to be mechanically and electrically fixed to one side of circuit board 30. Connection terminals 16 and ground terminal 18 of electrical connector 10 are joined to connection traces 32 and ground circuit 34, respectively, of circuit board 30, by soldering. Flexible printed circuit 40 is adapted to be inserted into and retained in electrical connector 10, which in turn is fixed to circuit board 30.

In the conventional structure of the electrical connector and circuit board described above, the overall height or profile of the combined circuit board/connector structure is relatively large. This brings about difficulty in the use of space in small electronic appliances. Furthermore, since the ground terminal is located on a surface below the connector housing, it is difficult to solder to the ground circuit of the circuit board.

SUMMARY OF THE INVENTION

Accordingly, the present invention is directed to an electrical connector for joining flexible printed board to a rigid circuit board that substantially obviates one or more of the problems due to limitations and disadvantages of the related art.

An object of the present invention is to provide an electrical connector for joining a flexible printed circuit to a circuit board, which minimizes the relative size of the electrical connector and circuit board combination, thereby maximizing the use of inner space of a small electronic device when the circuit board is placed inside the electronic device.

Another object of the present invention is to provide an electrical connector for joining a flexible printed circuit to a rigid circuit board, in which a ground terminal of the electrical connector is more simply and reliably connected and fixed to a ground terminal of the circuit board.

To accomplish the objects of the present invention, there is provided an electrical connector for joining a flexible printed circuit to a rigid printed circuit board comprising a connector housing adapted to be mounted within an opening in the printed circuit board and including a circuit connecting portion for receiving the flexible printed circuit; a plurality of connection terminals mounted within the housing and terminating in surface mount portions wherein upper surfaces of the surface mount portions are adapted to make contact with corresponding circuit traces on a lower surface of the printed circuit board; a ground terminal extending outwardly from each side of the connector housing wherein the upper surface of the ground terminals are coplanar with the upper surfaces of the surface mount portions of the connection terminals; and a circuit fastener rotatably mounted for up and down movement on the connector housing adapted to secure the flexible printed circuit within the circuit connecting portion of the housing whereby, when the electrical connector is placed and fixed within the opening of the circuit board, the combined profile of the connector and circuit board assembly is reduced by the thickness of the circuit board as compared to the prior art connector/circuit board structure.

The apparatus may further include a ground tab extending downwardly from the end of the ground terminal.

The apparatus further includes a circuit guide formed on each side of the circuit connecting portion, for guiding the flexible printed circuit during insertion into the connector housing. The circuit guide has a slope formed at an edge of the front side thereof, the slope inclining toward inside of the circuit guide.

The apparatus may further include a means for maintaining the fastening state of the circuit fastener. This means includes locking protrusions formed at both sides of the circuit fastener, and locking projections formed at predetermined portions of the circuit guide adjacent to the locking protrusions.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
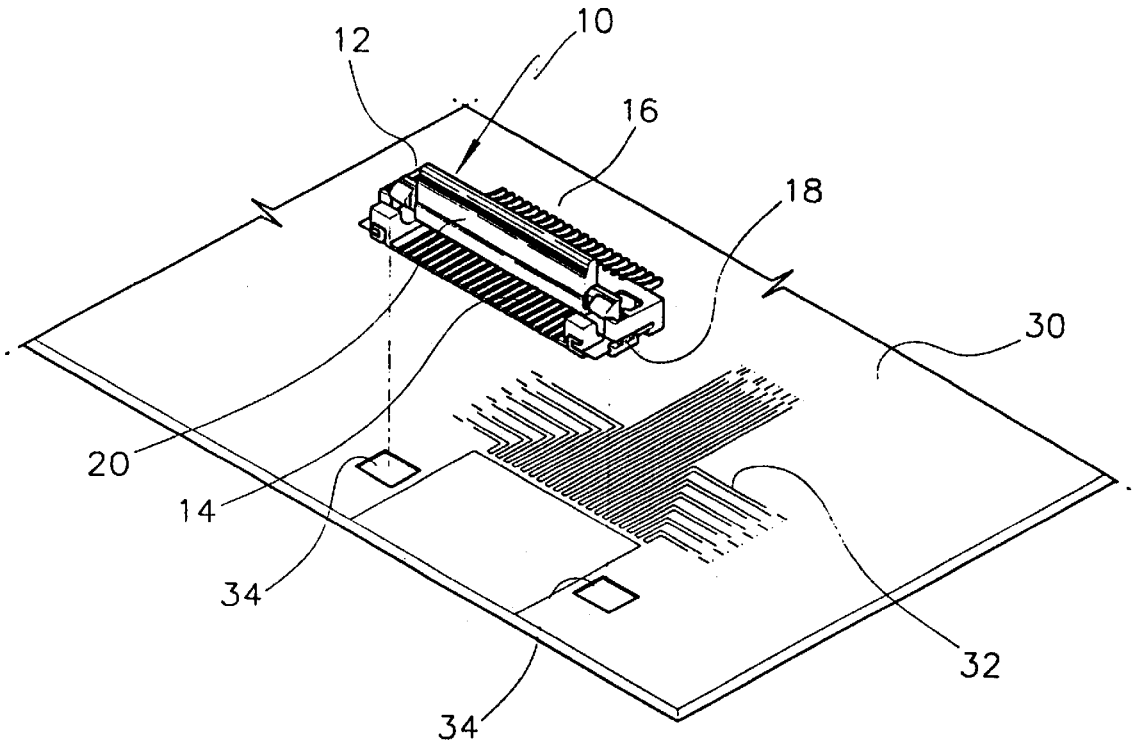
FIG. 1 PRIOR ART
FIG. 1 is an exploded perspective view showing a conventional electrical connector and a circuit board on which the connector is mounted.
Figure 2:
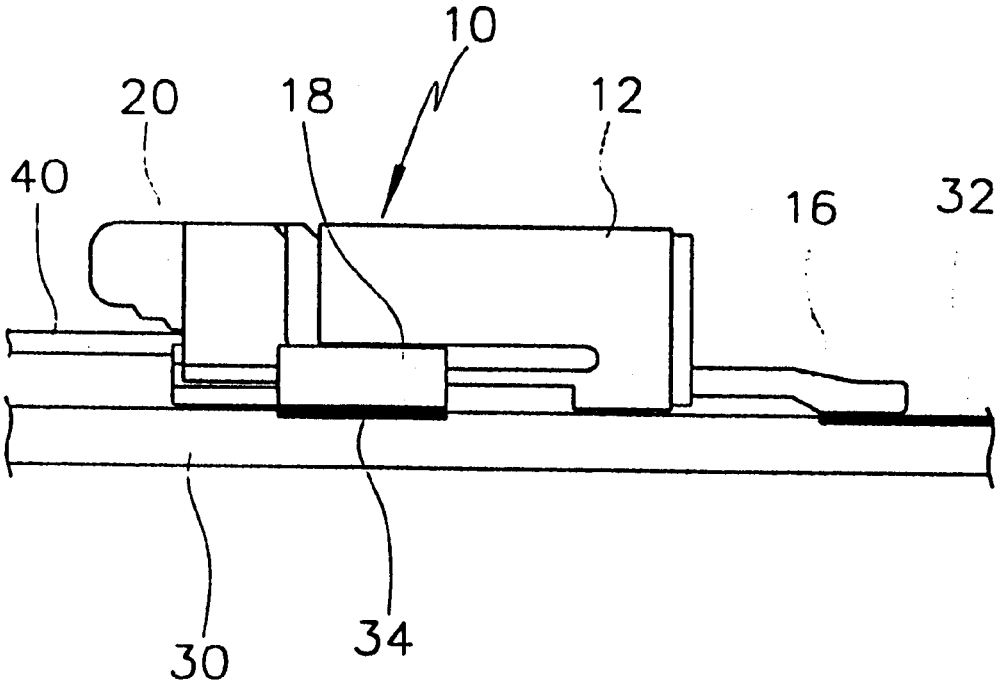
FIG. 2 PRIOR ART
FIG. 2 is a side elevational view of FIG. 1.
Figure 3:
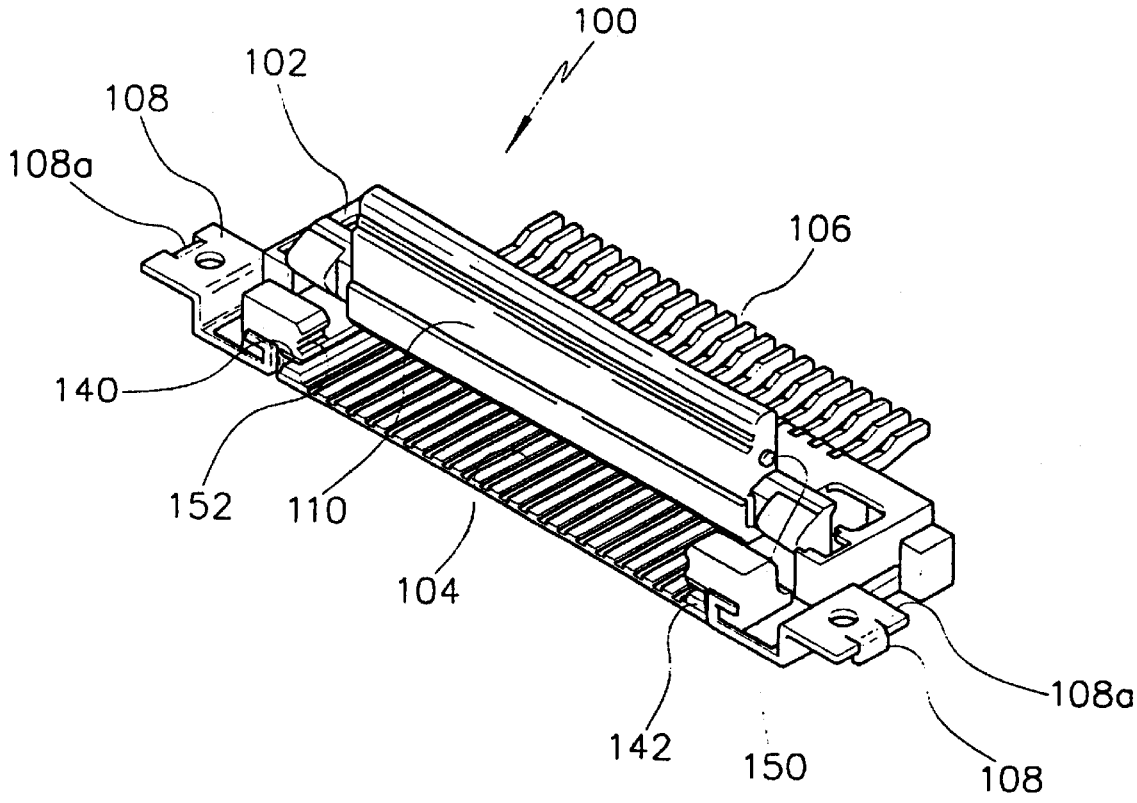
FIG. 3 is a perspective view of an electrical connector according to the present invention.
Figure 4:
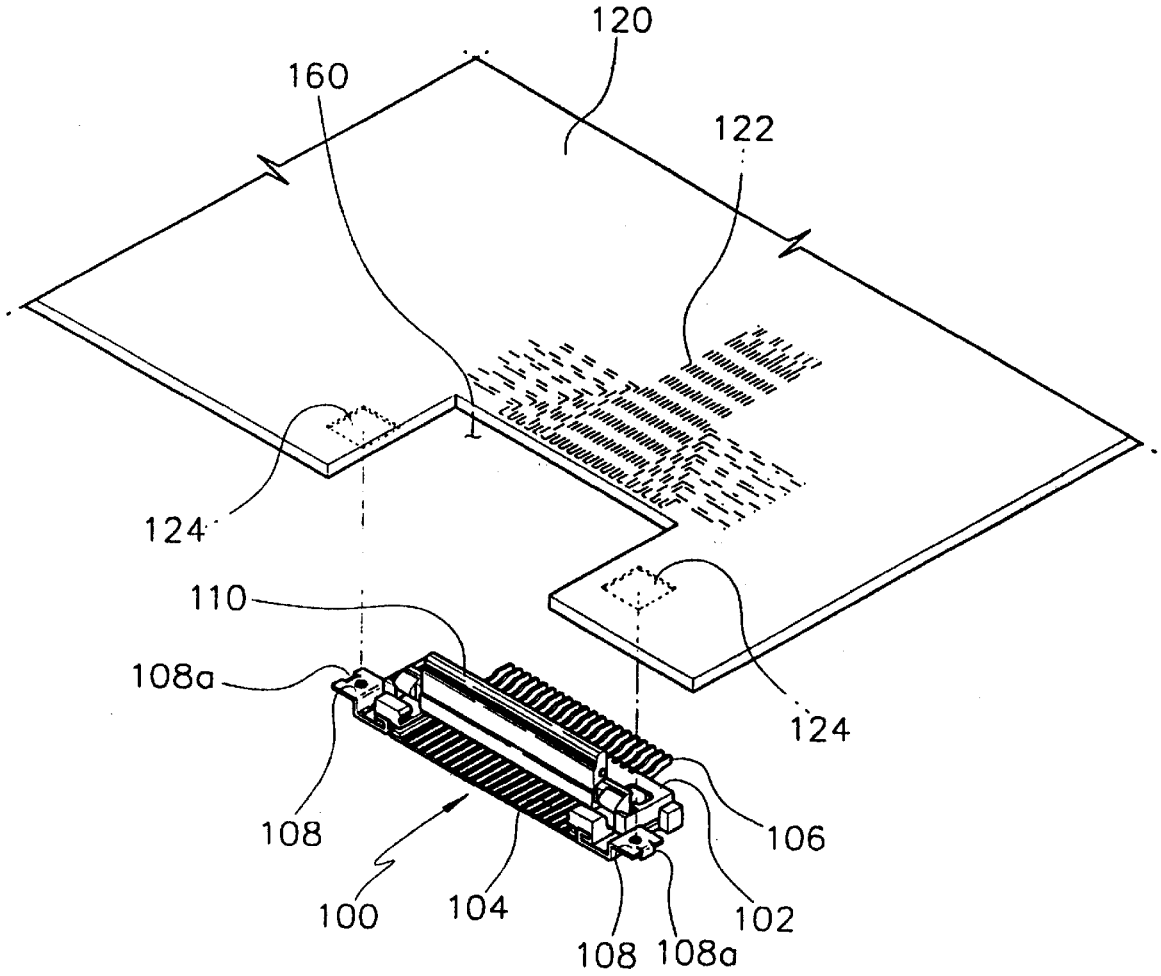
FIG. 4 is an exploded perspective view of the connector of FIG. 1 showing how the electrical connector of FIG. 1 mounts to the rigid circuit board.
Figure 5:
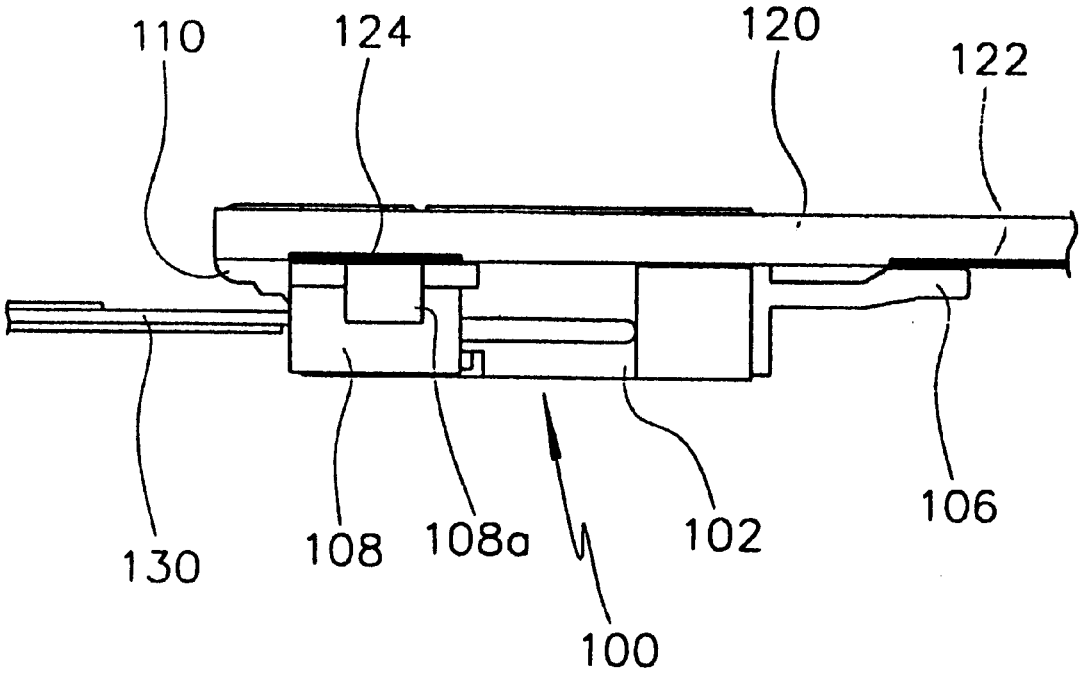
FIG. 5 is a side elevational view of FIG. 4.

Reference will now be made in detail to the preferred embodiments of the present invention, examples of which are illustrated in the accompanying drawings.

Referring to FIGS. 3 to 6, electrical connector 100 of the present invention includes a connector housing 102, a circuit connecting portion 104 formed in connector housing 102, a plurality of connection terminals 106 arranged in circuit connecting portion 104, a ground terminal 108 located at each side of connector housing 102, and a circuit fastener 110 rotatably mounted for up and down movement on connector housing 102.

Figure 6:
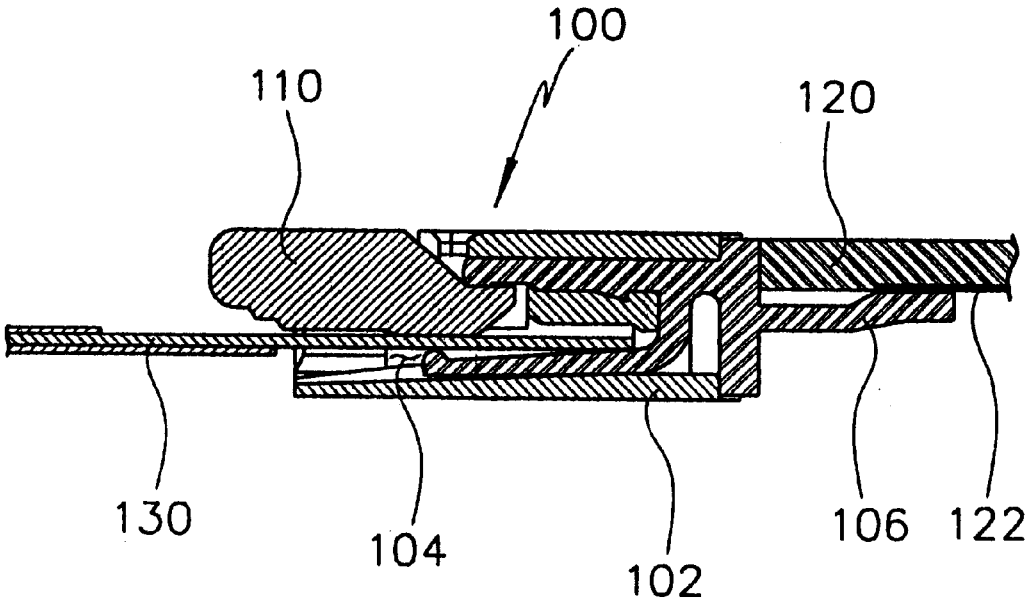
FIG. 6 is a cross-sectional view of FIG. 4.

Circuit connecting portion 104 is adapted to receive a flexible printed circuit 130 to mechanically and electrically join it to connection terminals 106. Circuit connecting portion 104 extends rearwardly from the front of connector housing 102, and is adapted to receive flexible printed circuit 130 therein. Connection terminals 106, electrically connected to connection traces 122 of circuit board 120, extend rearwardly from the inside of circuit connecting portion 104 to the outside of the connector terminating in surface mount portions which connect to rigid circuit board 120 (see FIG. 6). The distance between the upper surface of the surface mount portions of connection terminals 106 and an upper surface of connector housing 102 corresponds to the thickness of circuit board 120 (FIG. 6).

Ground terminals 108 located at each side of connector housing 102 ground and fix electrical connector 100 to circuit board 120 and are mechanically and electrically joined to a ground circuit 124 of circuit board 120 by soldering. Ground terminal 108 extends outwardly from each side of connector housing 102. The upper surface of ground terminals 108 is coplanar with the upper surface of the surface mount portions of connection terminals 106. That is, the distance between the upper surface of connector housing 102 to the upper surface of ground terminal 108 corresponds to the thickness of circuit board 120. Ground terminal 108 includes a ground tab 108*a* extending downwardly from an end thereof. Ground tab 108*a* prevents interference between neighboring electrical connectors 100 during shipping and handling. Circuit fastener 110 is rotatably mounted for up and down movement on connector housing 102 and retains flexible printed circuit 130 within housing 102 to prevent it from being separated from circuit connecting portion 104.

A C-shaped circuit guide 140 is formed on each side of circuit connecting portion 104 of electrical connector 100 to guide flexible printed circuit 130 during insertion into electrical connector 100. A slope or lead-in 142 is formed at a front edge of circuit guide 140 to facilitate insertion of flexible printed circuit 130.

Electrical connector 100 further includes means for maintaining the fastening state of circuit fastener 110 which prevents it from being removed from circuit connecting portion 104. The maintenance means is composed of locking protrusions 150 formed on both sides of circuit fastener 110 and corresponding locking projections 152 formed on a predetermined portion of circuit guide 140 adjacent to each locking protrusion 150. Circuit fastener 110 is rotated downward while flexible printed circuit 130 is positioned within circuit connecting portion 104 so that locking protrusions 150 are caught by locking projection 152. The fastening state of circuit fastener 110 is thereby maintained by the locking of locking protrusion 150 and locking projection 152.

Circuit board 120, to which electrical connector 100 is mechanically and electrically connected, has an opening 160 sized to correspond to the dimensions of connector housing 102 and is adapted to mount electrical connector 100. Connection traces 122 and ground circuit 124 of the circuit board are located around opening 160 on one surface of circuit board 120, to be connected to connection terminals 106 and ground terminal 108, respectively, of electrical connector 100. Connection terminals 106 and ground terminal 108 of electrical connector 100 are connected to connection traces 122 and ground circuit 124 of circuit board 120 by soldering.

The electrical connector for joining the flexible printed circuit to the rigid circuit board described above is summarized below. Connector terminals 106 extend rearwardly from the inside of circuit connecting portion 104 outside of the connector housing, terminating in surface mount portions, whereby upper surfaces of the surface mount portions of the connection terminals are coplanar with the upper surface of circuit board 120, which itself is located at a plane below the upper surface of the connector housing. Ground terminals 108 extend outwardly from each side of connector housing 102 so that the upper surface of the ground terminal is coplanar with the surface mount extensions of connection terminals 106. Circuit board 120 has an opening 160 sized to correspond to the dimensions of connector housing 102, and is adapted to mount electrical connector 100 therewithin. Circuit fastener 110 is rotatably mounted for up and down movement on one side of connector housing 102 to secure flexible printed circuit 130 within circuit connecting portion 104.

Ground tab 108*a* extends downwardly from an end of each ground terminal 108. Circuit guide 140 is formed on each side of circuit connecting portion 104 to guide flexible printed circuit 130 into circuit connecting portion 104. Slope 142 is formed at a front edge of circuit guide 140. The means for maintaining the fastening state of circuit fastener 110 includes locking protrusions 150 formed at both sides of circuit fastener 110 and locking projections 152 formed at corresponding areas on circuit guide 140, adjacent to locking protrusions 150 in the down position of circuit fastener 110.

Electrical connector 100 and circuit board 120 of the present invention are combined with each other as follows. Electrical connector 100 is placed in opening 160 of circuit board 120 while connector terminals 106 and ground terminal 108 of electrical connector 100 face connection traces 122 and ground circuit 124 of circuit board 120, respectively. Connection terminals 106 and ground terminal 108 of connector 100 are connected and fixed to connection traces 122 and ground traces 124, respectively, by soldering.

When electrical connector 100 is placed in opening 160 of circuit board 120 as described above, and as shown in FIG. 6, the portion of connector 100, ranging from the upper part of connection terminals 106 and ground terminal 108 to the top of connector housing 102, is located in opening 160, and the lower parts of connection terminals 106 and ground terminal 108 are projected downward from the lower surface of circuit board 120. Therefore, when electrical connector 100 is placed in opening 160, the thickness of the portion where connector 100 is connected and fixed to circuit board 120 is reduced by the thickness of circuit board 120. Consequently, the present invention provides electrical connector 100 and circuit board 120 having the aforementioned combination structure to reduce the overall height of the structure.

According to the present invention, the overall height of the combined structure of the electrical connector and circuit board is effectively reduced by the thickness of the rigid circuit board. This maximizes the available space when the circuit board on which the electrical connector is mounted is placed in a small electronic device. Furthermore, the ground terminals horizontally extend from both sides of the connector housing so that the electrical connector can be easily connected to the circuit board by soldering. Moreover, the ground tab extends downwardly from each end of the ground terminals to prevent interference and entanglement between adjacent connectors when they are packed, facilitating handling and packaging of such connectors.

It will be apparent to those skilled in the art that various modifications and variations can be made in the electrical connector of the present invention without go departing from the spirit or scope of the invention. Thus, it is intended that the present invention cover the modifications and variations of this invention provided they come within the scope of the appended claims and their equivalents.

We claim:

1. An electrical connector for joining a flexible printed circuit to a rigid printed circuit board having an upper surface and a lower surface, comprising:

a connector housing adapted to be mounted within an opening in the printed circuit board and including a circuit connecting portion for receiving the flexible printed circuit;

a plurality of connection terminals mounted within the housing and terminating in surface mount portions wherein upper surfaces of the surface mount portions are adapted to make contact with corresponding circuit traces on the lower surface of the printed circuit board;

a ground terminal extending outwardly from each side of the connector housing wherein the upper surface of the ground terminals are coplanar with the upper surfaces of the surface mount portions of the connection terminals; and a circuit fastener rotatably mounted on the connector housing for movement between open and closed positions to secure the flexible printed circuit within the circuit connecting portion of the housing, the circuit fastener in its open position projecting above the upper surface of the printed circuit board.

2. The connector as claimed in claim 1, further comprising a ground tab extending downwardly from outer ends of each ground terminal.

3. The connector as claimed in claim 1, further comprising a circuit guide being formed on each side of the circuit connecting portion for guiding the flexible printed circuit when it is inserted into the connector housing.

4. The connector as claimed in claim 3, wherein the circuit guide includes a slope formed at a front edge thereof.

5. The connector as claimed in claim 1, further comprising a means for maintaining a fastening state of the circuit fastener.

6. The connector as claimed in claim 5, wherein the means for maintaining the fastening state of the circuit fastener includes locking protrusions formed at both sides of the circuit fastener and corresponding locking projections formed at predetermined portions of the circuit guide.

7. The connector as claimed in claim 1 wherein said connector housing is adapted for mounting within an opening in an edge of the printed circuit board.

8. An electrical connector for joining a flexible printed circuit to a rigid printed circuit board having an upper surface and a lower surface, comprising:

a connector housing adapted to be mounted within an opening in an edge of the printed circuit board and including a circuit connecting portion for receiving the flexible printed circuit;

a plurality of connection terminals mounted within the housing and terminating in surface mount portions wherein upper surfaces of the surface mount portions are adapted to make contact with corresponding circuit traces on the lower surface of the printed circuit board; and a circuit fastener rotatably mounted on the connector housing for movement between open and closed positions to secure the flexible printed circuit within the circuit connecting portion of the housing, the circuit fastener in its open position projecting above the upper surface of the printed circuit board.

9. The connector as claimed in claim 8, further comprising a circuit guide being formed on each side of the circuit connecting portion for guiding the flexible printed circuit when it is inserted into the connector housing.

10. The connector as claimed in claim 9, wherein the circuit guide includes a slope formed at a front edge thereof.

11. The connector as claimed in claim 8, further comprising a means for maintaining a fastening state of the circuit fastener.

12. The connector as claimed in claim 11, wherein the means for maintaining the fastening state of the circuit fastener includes locking protrusions formed at both sides of the circuit fastener and corresponding locking projections formed at predetermined portions of the circuit guide.

* * * * *